US009617643B2

(12) United States Patent
Lee et al.

(10) Patent No.: US 9,617,643 B2
(45) Date of Patent: Apr. 11, 2017

(54) METHODS FOR COATING METALS ON HYDROPHOBIC SURFACES

(71) Applicant: Board of Trustees of Michigan State University, East Lansing, MI (US)

(72) Inventors: Ilsoon Lee, Okemos, MI (US); Wei Wang, East Lansing, MI (US); Ankush Gokhale, East Lansing, MI (US)

(73) Assignee: Board of Trustees of Michigan State University, East Lansing, MI (US)

( * ) Notice: Subject to any disclaimer, the term of this patent is extended or adjusted under 35 U.S.C. 154(b) by 601 days.

(21) Appl. No.: 14/063,720

(22) Filed: Oct. 25, 2013

(65) Prior Publication Data

US 2014/0120255 A1 May 1, 2014

Related U.S. Application Data

(60) Provisional application No. 61/719,269, filed on Oct. 26, 2012.

(51) Int. Cl.
*C23C 18/20* (2006.01)
*C23C 18/30* (2006.01)

(52) U.S. Cl.
CPC ..... *C23C 18/2086* (2013.01); *C23C 18/30* (2013.01)

(58) Field of Classification Search
None
See application file for complete search history.

(56) References Cited

U.S. PATENT DOCUMENTS 6,060,410 A 5/2000 Gillberg-LaForce et al.
2004/0191504 A1 9/2004 Stevenson et al.
2006/0111470 A1* 5/2006 Takashima ..... H01M 4/86 523/210
2008/0014356 A1 1/2008 Lee et al.
2008/0038476 A1 2/2008 Cordani
2009/0017317 A1 1/2009 Lancsek et al.
2009/0280631 A1* 11/2009 Gambino ..... H01L 21/28079 438/588
2010/0136244 A1 6/2010 Inagawa et al.
(Continued)

FOREIGN PATENT DOCUMENTS

JP WO 2011118439 A1 * 9/2011 ..... C23C 18/1879

OTHER PUBLICATIONS

Tran, V.H., et al; "Interactions in Metal-polymer-metal Interfaces"; Polymer, 34(15): 3179-83 (1993).
(Continued)

*Primary Examiner* — Lan Vinh
*Assistant Examiner* — Bradford Gates
(74) *Attorney, Agent, or Firm* — Harness, Dickey & Pierce, P.L.C.

(57) ABSTRACT

A method of plating a metal on a hydrophobic polymer, especially in the shape of small particles, involves: (a) contacting a surface of hydrophobic polymer substrate with a polycation such as poly(allylamine hydrochloride) to create a treated surface; (b) contacting the treated surface with a catalyst; and then (c) immersing the surface in a electroless metal plating bath to create a coating of metal on the surface. Metals include copper, silver, gold, nickel and cobalt. Catalysts are selected from compounds containing palladium, platinum, tin, copper, or nickel salts. Damaging surface treatments such as etching by plasma or acid are avoided.

19 Claims, 15 Drawing Sheets

(56) References Cited

U.S. PATENT DOCUMENTS

2010/0327237 A1* 12/2010 Takai ..... B22F 1/02 252/514
2011/0159191 A1* 6/2011 Koiwa ..... C23C 18/1889 427/304
2012/0192758 A1* 8/2012 Imori ..... C23C 18/1879 106/1.28

OTHER PUBLICATIONS

Garcia, A., et al.; "ABS Polymer Electroless Plating through a One-Step Poly(acrylic acid) Covalent"; ACS Applied Material Inferfaces, 2(4): 1177-83 (2010).
Lee, I., et al; "Selective Electroless Nickel Plating of Particle Arrays on Polyelectrolyte Multilayers"; Chemistry of Materials, 15(24): 4583-89 (2003).
Wang, T.C., et al.; "Selective Electroless Nickel Plating on Polyelectrolyte Multilayer Platforms"; Langmuir, 17(21): 6610-15 (2001).
Charbonnier, M., et al; Plasma Treatment Process for Palladium Chemisorption Onto Polymers Before Electroless Deposition; Journal of the Electrochemical Society, 143(2): 472-80 (1996).
Tom C. Wang, et al; "Manipulating Nanoparticle Size within Polyelectrolyte Multilayers via Electroless Nickel Deposition"; Chemistry of Materials, 15(1): 299-304 (2003).
Srividhya Kidambi, et al; "Selective Hydrogenation by Pd Nanoparticles Embedded in Polyelectrolyte Multilayers"; Journal of the American Chemical Society 126(9): 2658-59 (2004).
Charbonnier, M., et al, "Ni direct electroless metallization of polymers bya new palladium-free process"; Surface & Coatings Technology 200 (2006) 5028-5036.
Charbonnier, M., et al; "Copper metallization of polymers by a palladium-free electroless process"; Surface & Coatings Technology 200 (2006) 5478-5486.

* cited by examiner

METHODS FOR COATING METALS ON HYDROPHOBIC SURFACES

CROSS-REFERENCE TO RELATED APPLICATIONS

This application claims the benefit of U.S. Provisional Application No. 61/719,269 filed on Oct. 26, 2012, the full disclosure of which is hereby incorporated by reference.

GOVERNMENT SUPPORT

This invention was made with U.S. Government support under CMMI-0928835 awarded by the National Science Foundation (NSF) and W912HQ-12-C-0020 awarded by the Department of Defense, Strategic Environmental Research and Development Program (SERDP). The Government has certain rights in the invention.

INTRODUCTION

The present technology relates to methods for coating a metal on a surface of a hydrophobic substrate. Such methods, in particular, relate to electroless metal deposition of metals on polyethylene or other hydrophobic polymer surfaces.

Deposition of metals onto non-metallic materials (also referred to as "metallization") is of wide interest because of the potential for creating heterogeneous materials having properties of both the metallic and non-metallic materials. The improved overall properties are usually ascribed to the properties associated with metals, such as abrasion resistance, friction reduction, electrical and thermal conductivity, or even mechanical hardening. However, methods for metallization are complex, due to the inherent lack of affinity for the metallic and non-metallic materials.

Various metal deposition methods have been applied in the art. For non-conductive surfaces, such as polymers, such methods include physical and chemical vapor deposition (PVD and CVD), sputter deposition, and electroless deposition. Electroless deposition is widely used because of its equipment simplicity and flexibility. Electroless metal deposition is a catalytic, redox reaction of a metal ion in an aqueous solution (with a reducing chemical agent), without external electrical field being applied. Electroless metal deposition usually includes three major steps: 1) a surface treatment or conditioning; 2) application of an appropriate catalyst on the substrate surface; 3) metal electroless deposition. Rinsing is required between the steps. However, in the first step, in order to modify the functionality of the substrate surface so that catalyst can be sequentially attached, harsh or toxic surface conditioning steps are usually employed. These surface conditionings include a harsh chemical etching (e.g. sulfuric and chromic acids), or a plasma treatment, or an UV source radiation, or a laser induced seeding. Those treatment/conditioning processes usually involve harsh/toxic chemical handing that could harm the concerned personnel, and sophisticated equipment that is expensive to acquire/replace. Both will increase the manufacturing cost.

SUMMARY

The present technology provides methods for electroless deposition of metals, such as nickel, on various hydrophobic polymer substrates. Such methods may eliminate the need for harsh and toxic treatment of the substrate.

In various embodiments, methods comprise:

(a) contacting a surface of the hydrophobic polymer substrate with a polycation such as poly(allylamine hydrochloride) to create a treated surface;

(b) contacting the treated surface with a catalyst; and then (c) immersing the surface in a electroless metal plating bath to create a coating of metal on the surface.

The metal may be any metal suitable for electroless deposition, as would be understood by one of ordinary skill in the art. Such metals include copper, silver, gold, nickel and cobalt. Suitable electroless catalysts include metal salts or metal compounds containing a metal in a positive oxidation state. In various embodiments, catalysts are selected from compounds containing palladium, platinum, tin, copper, or nickel. When the surface is contacted with such catalysts, the positive metal ions adsorb onto the surface. When the surface is then exposed to the electroless plating bath, the positive metals of the catalyst are reduced in situ to the zero-valent metal, which serve as sites for the reduction and plating of metal ions from the electroless plating bath.

FIGURES

The present technology will become more fully understood from the detailed description and the accompanying drawings, as briefly described below.

FIGS. 3-6 include micrographs of EDX (energy dispersive x-ray) mapping and scanning electron microscope (SEM) images for substrates coated according to methods of the present technology.

Figure 7:
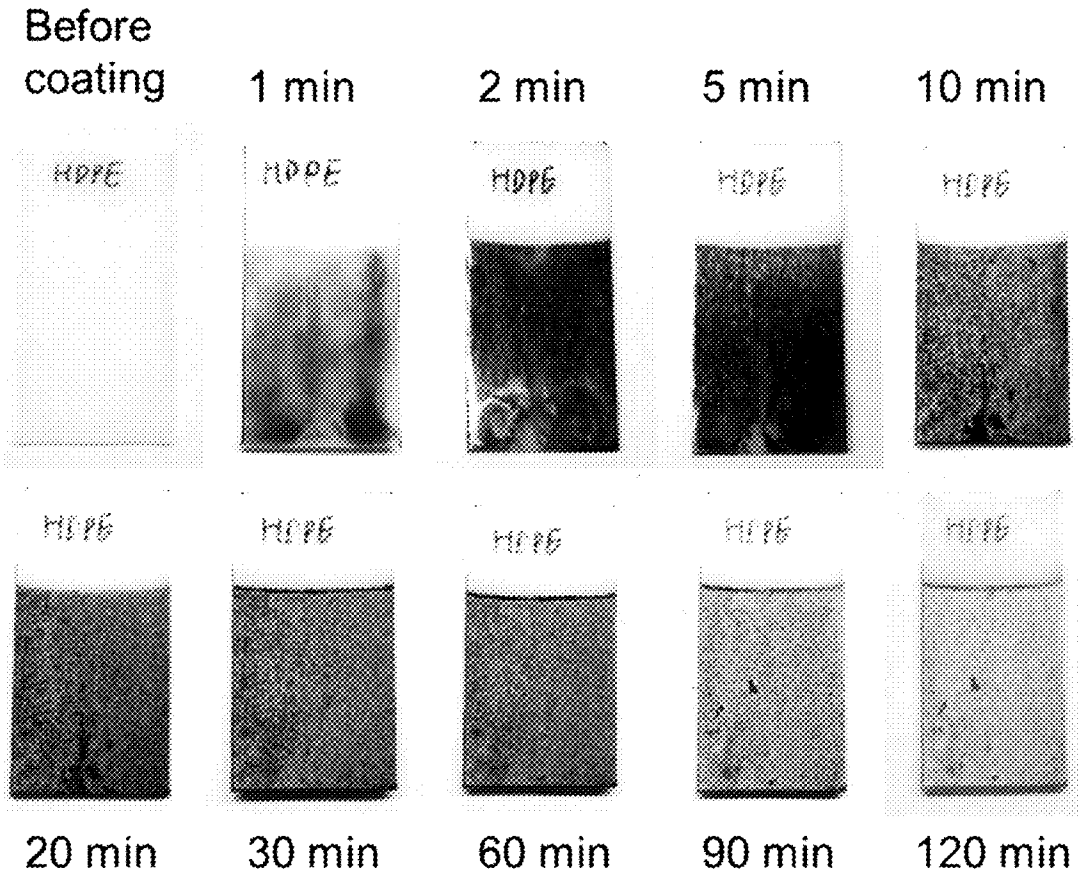
Figure 8:
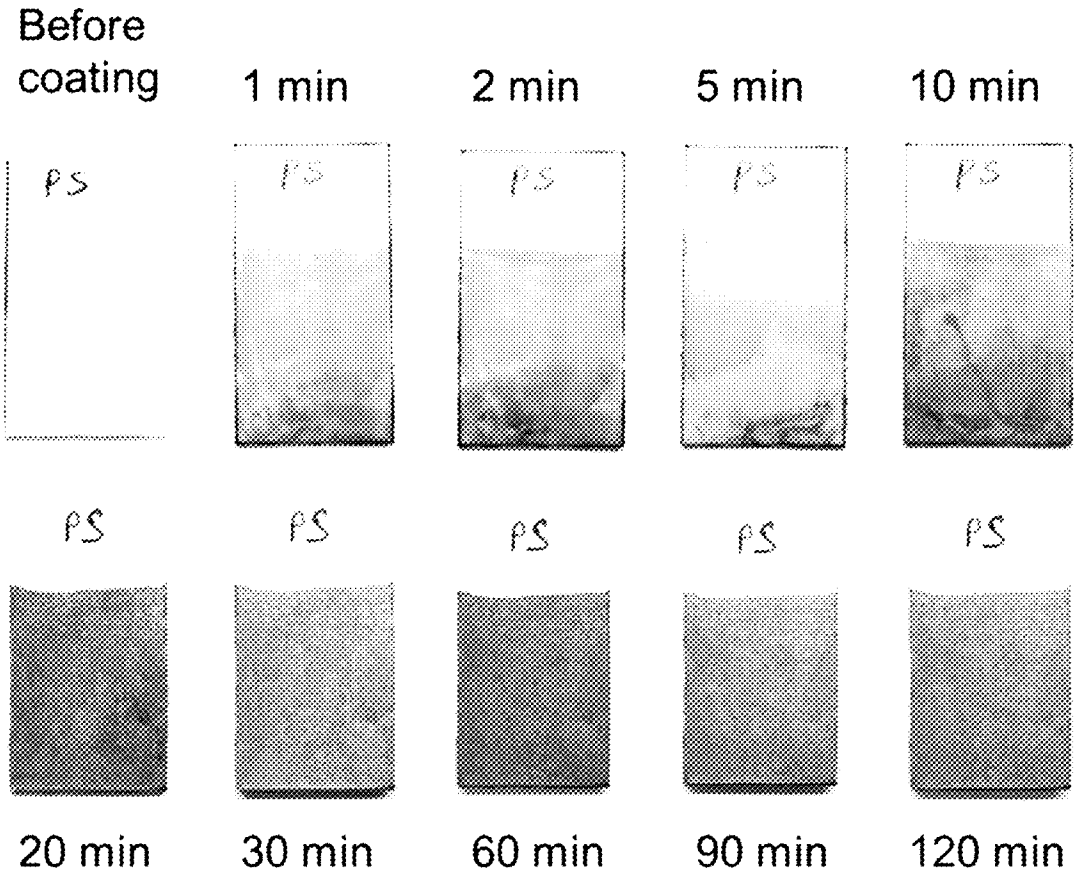

FIGS. 7 and 8 include photographs of substrates coated according to methods of the present technology.

Figure 9:
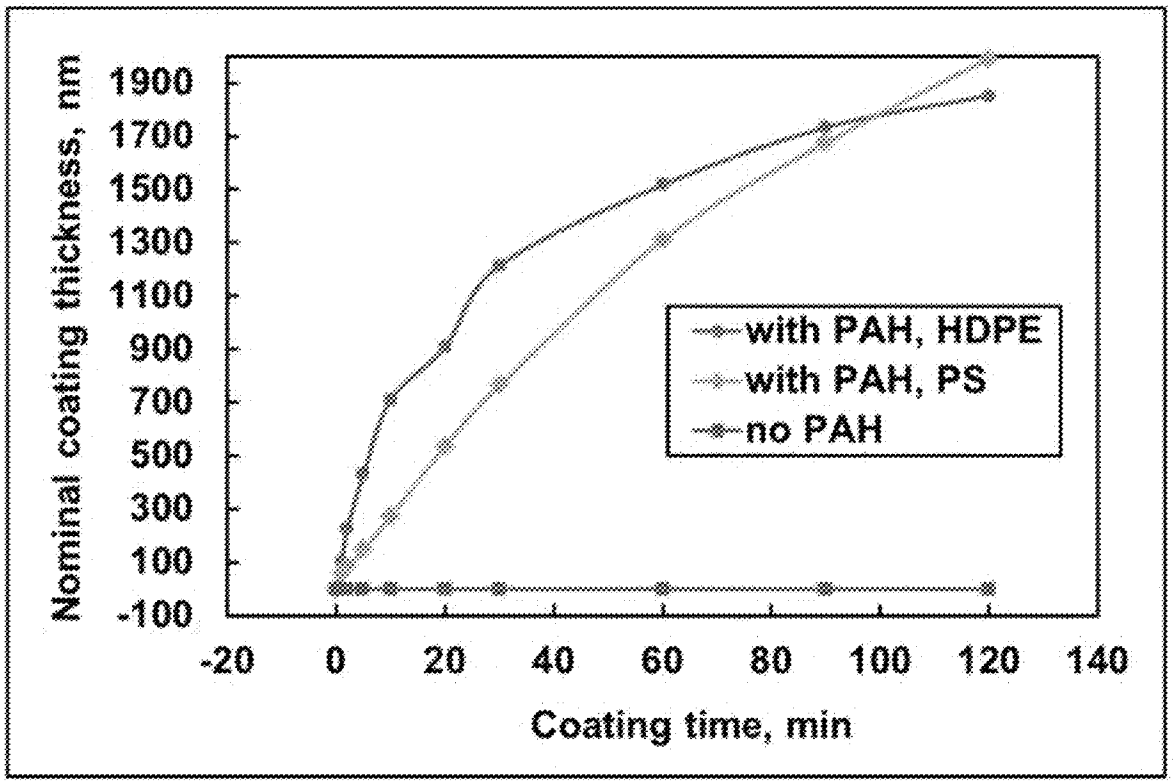

FIG. 9 is a graph showing the thickness of coating for substrates as function of time.

Figure 10:
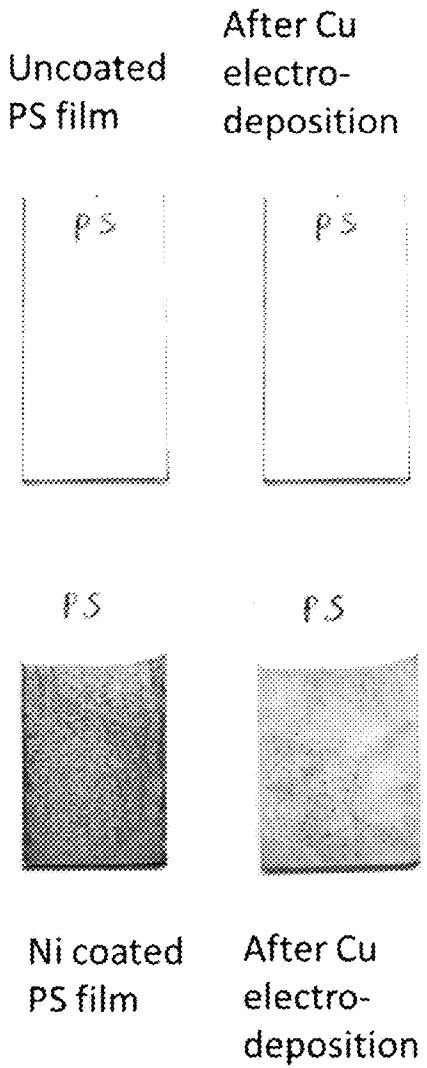

FIG. 10 includes photograph of substrates coated according to methods of the present technology.

Figure 11:
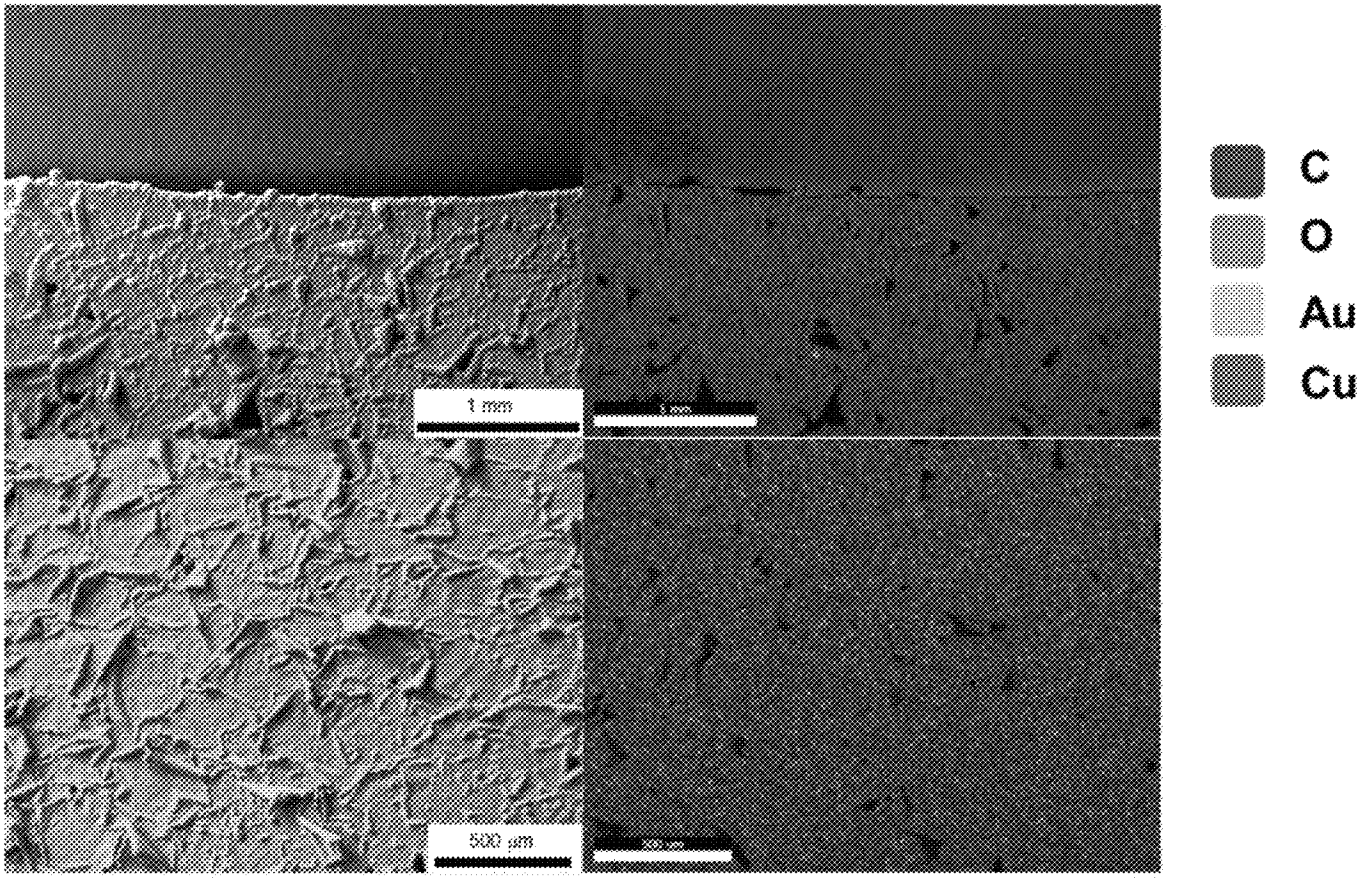

FIG. 11 includes micrographs of EDX mapping and SEM images for substrates having a copper coating on a nickel coated polystyrene sheet according to methods of the present technology. Au (gold) was deliberately sputter coated for imaging purposes. Upper left is a SEM image at the edge of Cu coating; upper right is the corresponding EDX elemental mapping (36 wt % of C, 3 wt % of O, 21 wt % of Au, 39 wt % of Ni); lower left is a SEM image at the main coating body; lower right is the corresponding EDX elemental mapping (3 wt % of O, 14 wt % of Au, 82 wt % of Ni).

Figure 12:
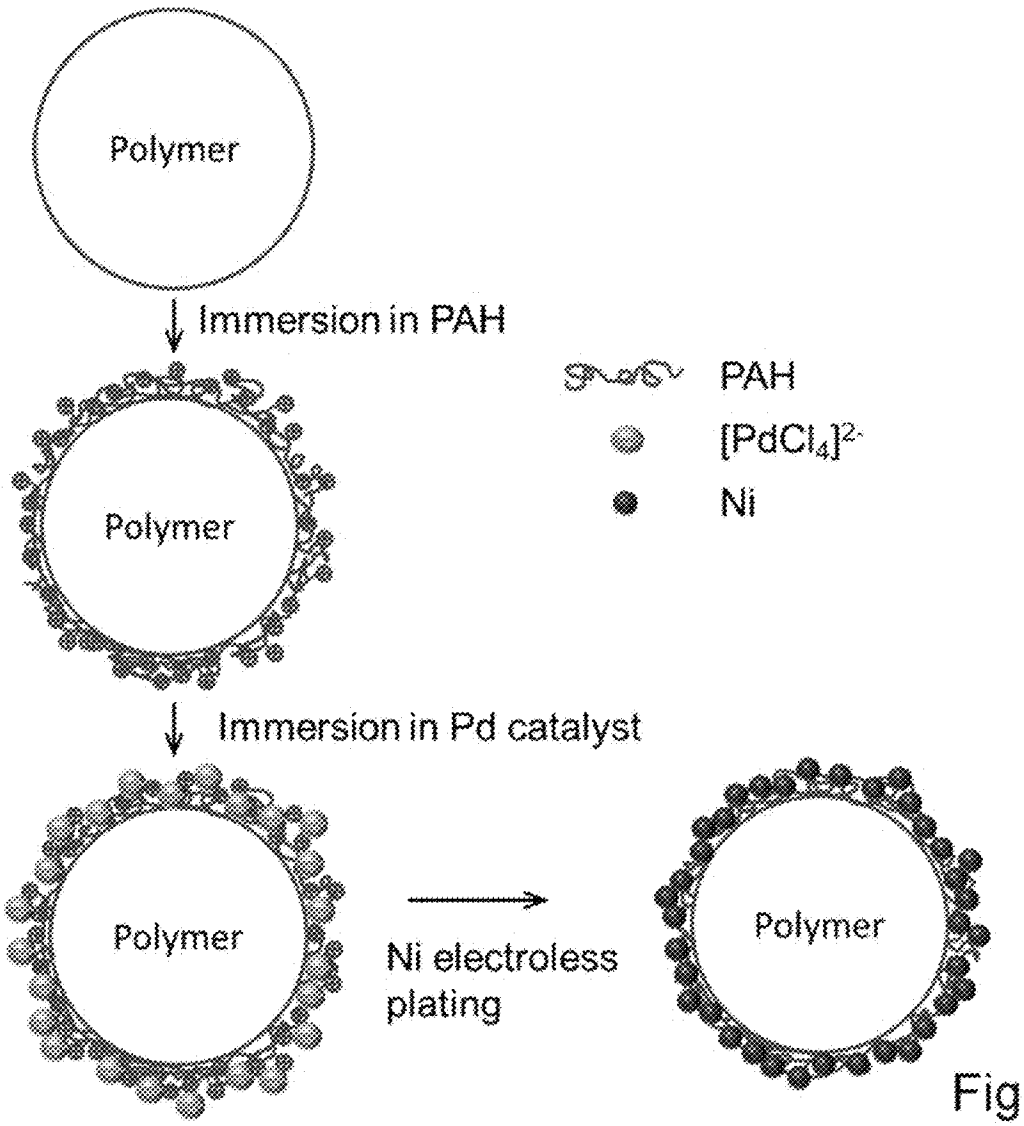

FIG. 12 is flow chart depicting a process of the present invention.

Figure 13:
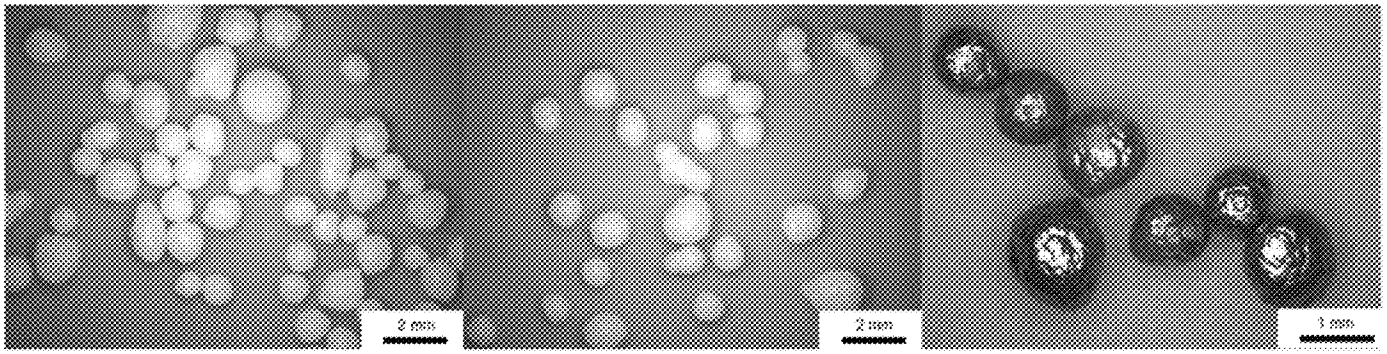

FIG. 13 includes photographs of substrates coated according to methods of the present technology.

Figure 14:
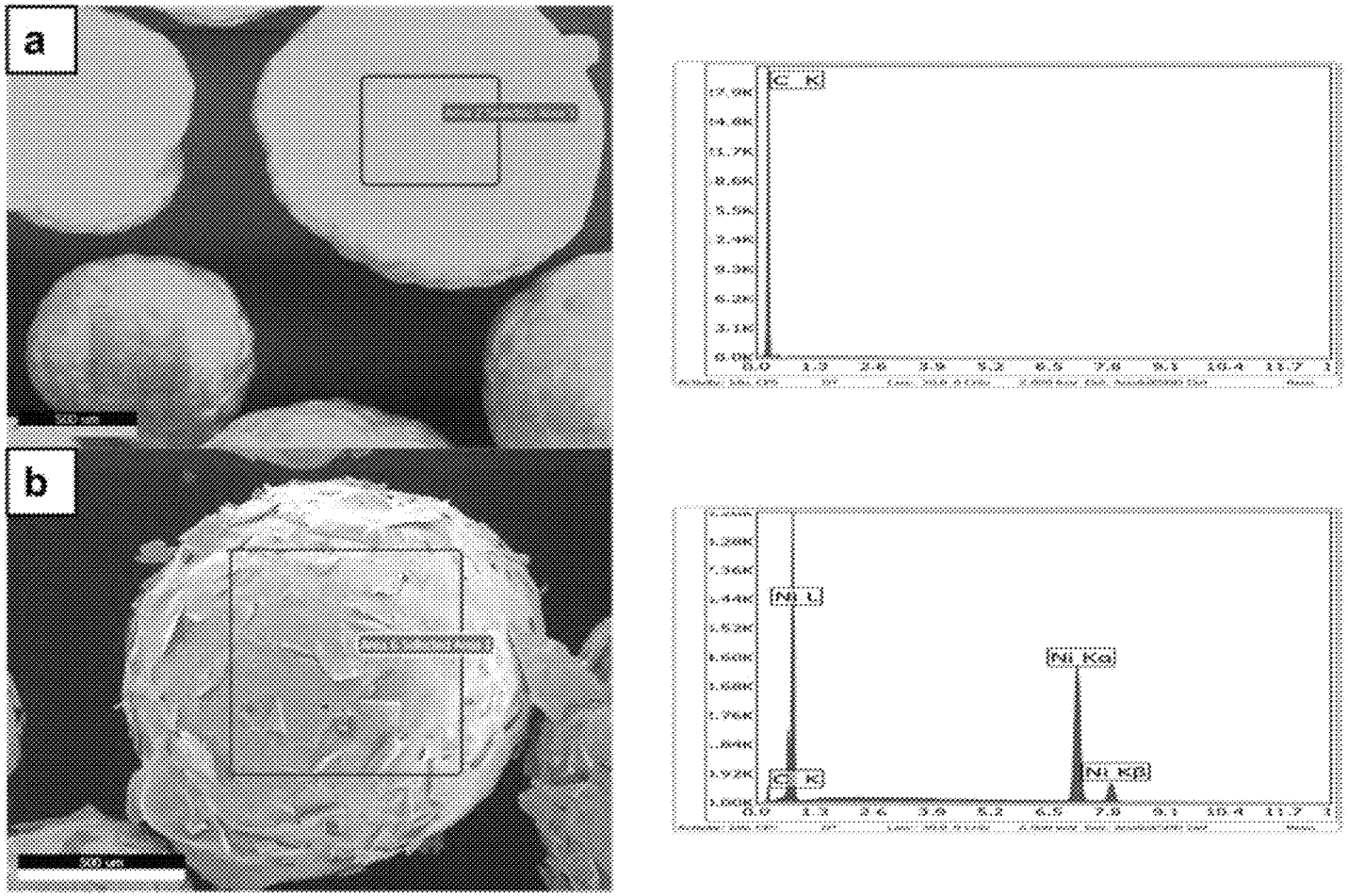
Figure 15:
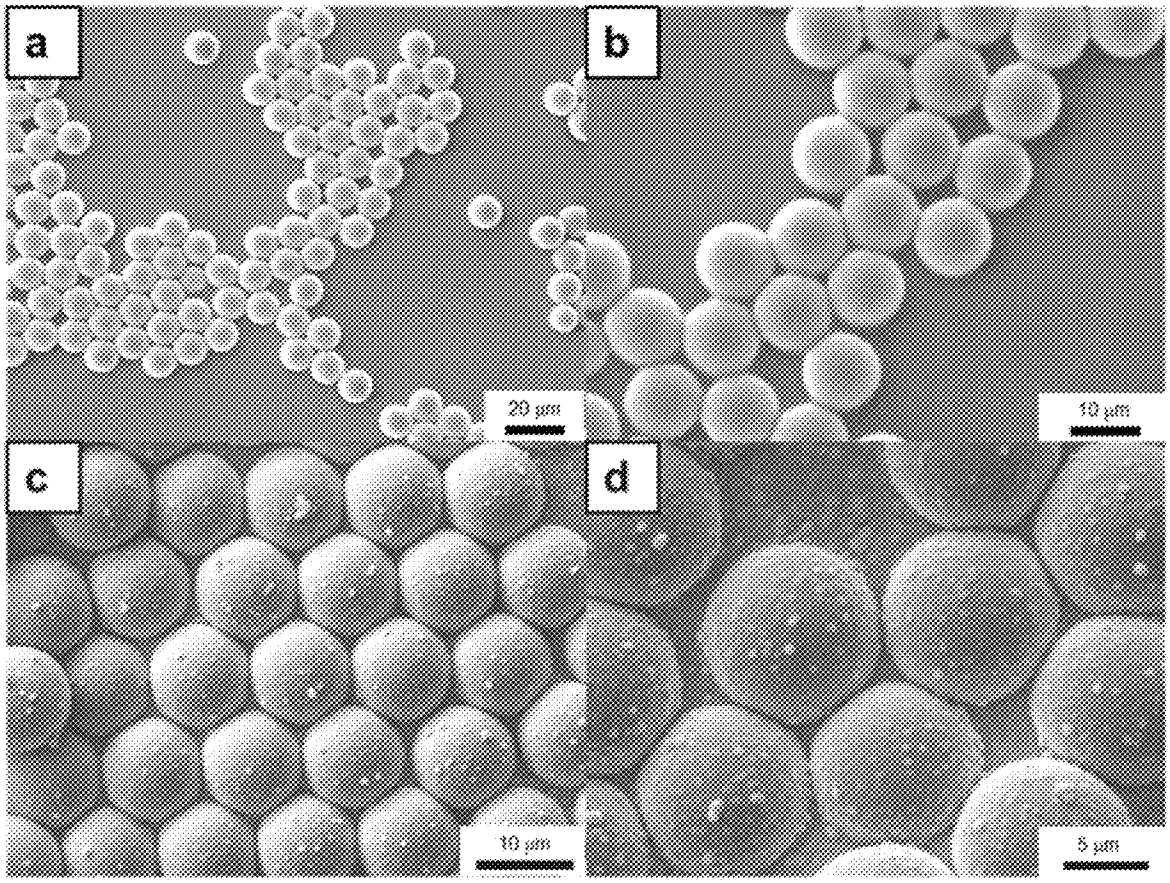

FIGS. 14 and 15 include micrographs of EDX mapping and SEM images for substrates coated according to methods of the present technology.

It should be noted that the figures set forth herein are intended to exemplify the general characteristics of materials and methods among those of the present technology, for the purpose of the description of certain embodiments. These figures may not precisely reflect the characteristics of any given embodiment, and are not necessarily intended to define or limit specific embodiments within the scope of this technology.

DETAILED DESCRIPTION

The following description of technology is merely exemplary in nature of the composition, manufacture and use of one or more inventions, and is not intended to limit the scope, application, or uses of any specific invention claimed in this application or in such other applications as may be filed claiming priority to this application, or patents issuing therefrom. A non-limiting discussion of terms and phrases intended to aid understanding of the present technology is provided at the end of this Detailed Description.

The present technology provides systems, materials and methods for the deposition of metals on non-metallic surfaces of a substrate, particularly hydrophobic surfaces. The substrate may be a bulk material, work-piece, component, product or other rigid or flexible structure having a hydrophobic surface amenable to coating with a metal. Such structures may be, for example, thin sheets, pellets, microspheres, and blocks. In various embodiments, three-dimensional nanoparticle, microparticles, and millimeter scale particles may be coated using methods of this technology. Advantageously, the methods of the current teachings can be used to plate flat surfaces as well as smaller particles such as pellets, spheres, and other shapes of millimeter, micrometer, or nanometer dimension.

In one embodiment, a method for coating a metal on a hydrophobic surface of a substrate includes the steps of:

(a) contacting the surface with poly(allylamine hydrochloride) (PAH) to create a treated surface;
(b) contacting the treated surface with a catalyst; and
(c) immersing the surface in an electroless plating bath of the metal to create a coating of the metal on the surface.

Various parameters of the method, such as the nature of the substrate, catalyst, and plating bath, are described in more detail herein.

In another embodiment, a method for coating a metal on the surface of a substrate comprising a hydrophobic polymer includes the steps of:

(a) contacting the surface with a polycation to create a modified surface;
(b) applying alternating layers of polyanion and polycation to the modified surface to make a treated surface having a surface charge that is positive or negative;
(b) contacting the treated surface with a catalyst; and
(c) immersing the surface in an electroless plating bath of the metal to create a coating of the metal on the surface, Again with the understanding that further of description of substrate, catalyst, bath, polycation, polyanion, and metals can be combined in the listed steps to describe further embodiments.

In a third non-limiting embodiment, a method for forming a metal coating on a substrate comprising a hydrophobic polymer includes the steps of:

(a) contacting the substrate with poly(allylamine hydrochloride) (PAH) to create a treated surface;
(b) contacting the treated surface with a catalyst comprising Pd, Pt, Sn, Ni, or Cu; and
(c) immersing the surface in an electroless metal plating bath to create a coating of the metal on the surface, wherein the metal is nickel or copper. Again, further description of substrate, catalyst, and other features are provided in the current teachings. Unless context dictates otherwise, descriptions of various limitations in the embodiments can be mixed and matched to provide other descriptive and non-limiting embodiments.

Methods of making a metal coated plastic substrate are provided. It is to be understood that the present disclosure also provides a description of the articles made using the processes. In particular embodiments, metal plated substrates such as spheres or particles of the noted dimension are provided with a metal coating such as copper, nickel, gold, silver, or cobalt. In addition to the metal plating, the articles have a polycation such as PAH disposed between the substrate and the metal coating. Further, the surface of the substrate in the articles is not damaged by treatment with plasma etching, acid etching, or similar process. The methods also provide polymer blocks, sheets, and other shapes similarly coated.

The substrate may be homogenous comprising hydrophobic materials, or may be heterogeneous comprising one or more hydrophobic or non-hydrophobic materials in layers or other configurations, wherein the substrate has an outer surface comprising a hydrophobic material. The surface may comprise the entire surface of the substrate, or a portion thereof. In some embodiments, the surface is a portion of the surface of the substrate defined by masking areas of the substrate that are not to be contacted with the materials used in the present methods.

In a particular embodiment, the substrates are in the form of small particles that are difficult or impossible to metallize electrolessly when a treated surface is to be prepared with conventional processes like plasma etching or strong acid etching. For example, plasma etching cannot be carried out uniformly on spherical particles. In addition, both plasma and acid etching damage the surface and affect the physical and chemical properties of the surface. On the other hand, the current technology, wherein a treated surface is prepared using hydrophobic interactions of the hydrophobic surface with a polycation such as PAH, does not damage the original polymer surface.

Nanosized and microsized particles of hydrophobic polymers are electrolessly coated with methods of the current technology. Nanosized particles include those having dimensions on the order of a few nanometers up to about 1000 nm. Examples include particles of dimension 10-1000 nm, 10-500 nm, 10-200 nm, 100-1000 nm, 100-500 nm, and 100-300 nm. Microsized particles include those having dimensions on the order of a few micrometers (μm) up to about 1000 μm, or about 1 mm. Examples include particles of dimension 10-1000 μm, 10-500 μm, 10-200 μm, 100-1000 μm, 100-500 μm, and 100-300 μm. Other particles are characterized by a dimension from a tenth or a few tenths of a millimeter up to 10 or 20 mm or so. Examples include 0.1-10 mm, 0.1-5 mm, 0.1-2 mm, 0.1-1 mm, 0.5-10 mm, 0.5-5 mm, 0.5-2 mm, 0.5-1 mm, 1.0-10 mm, 1.0-5 mm, and 1.0-2 mm. It is to be understood that for perfectly spherical particles, the dimension corresponds to the diameter of the sphere, while for other particles, the dimension corresponds to a size along a maximum dimension of the particle. Further examples are given in the Examples below, and in the Figures.

Hydrophobic materials among those useful here include hydrophobic polymers. Such polymers include low density polyethylene (LDPE), high density polyethylene (HDPE), polypropylene (PP) and polystyrene (PS).

Figure 1:
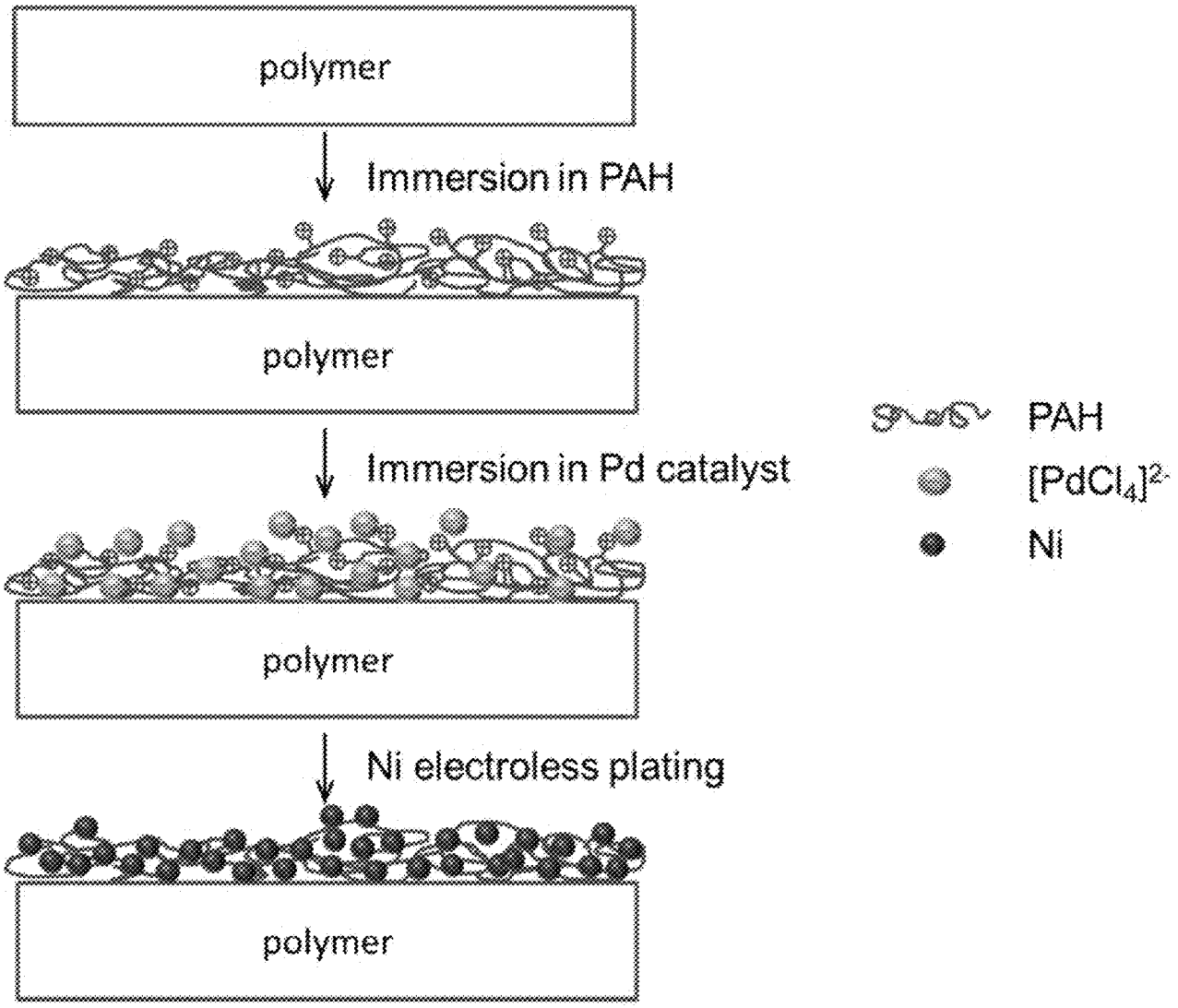
FIG. 1 is flow chart depicting a process of the present invention.

With reference to FIG. 1, the present technology provides methods for coating a metal on a hydrophobic surface of a substrate, comprising (a) contacting the surface with poly(allylamine hydrochloride) ("PAH") to create a treated surface;

(b) contacting the treated surface with a catalyst; and then (c) immersing the surface in an electroless plating bath of the metal to create a coating of the metal on the surface.

In some embodiments, the surface of the substrate is rinsed, such as with a surfactant composition, prior to contacting the surface with PAH.

Electroless deposition is a chemical reduction process based on the catalytic reduction of metal ions in an aqueous solution and subsequent deposition of reduced metal without electrical energy. The process is described, for example, in Mallory et al., Ed., Electroless Plating-Fundamentals and Applications, William Andrew Publishing/Noyes (1990), the disclosure of which is incorporated by reference. ELD catalysts activate the electroless deposition process on non-metallic surfaces such as the charged PEM surfaces used here. Catalysts are well known, and include stannous and palladium compounds, including the chlorides of each. A preferred catalyst is sodium tetrachloropalladate(II), $Na_2[PdCl_4]$. Electroless plating baths contain chemical agents that reduce the plating metal, along with source of metal ions that are to be reduced and plated. Non-limiting examples of reducing agents include boron compounds such as sodium borohydride, $Na_2BH_4$. A non-limiting example of an electroless bath contains 2.0 g nickel sulfate, 1.0 g sodium citrate, 0.5 g lactic acid, 0.1 g DMAB (dimethylamine borane), in 50 mL of deionized water. The bath pH is adjusted to about 6.5, for example using 1.0M sodium hydroxide (NaOH). Methods of electroless deposition, materials, and compositions useful in the present technology are described in U.S. Patent Application Publication 2008/0014356, Lee et al., published Jan. 17, 2008, incorporated by reference herein.

The methods of the present technology comprise contacting a hydrophobic surface with a polycation such as poly (allylamine hydrochloride) ("PAH") to create a treated surface. Without limiting the scope and benefits of the present technology, in various embodiments the hydrophobic interactions between the polycation and the hydrophobic polymer substrates help eliminate the need for toxic and/or harsh surface treatment steps for catalyst adsorption/immobilization such as are required in metallization methods among those known in the art.

Polycations include poly(diallyldimethylammonium chloride) (PDAC), branched poly ethyleneimine (BPEI), linear poly ethyleneimine (LPEI), and poly(allylamine hydrochloride) ("PAH"). The polycation is applied to the hydrophobic surface by exposing the surface to a solution of the polycation for a time sufficient for hydrophobic interactions with the surface to take place. The surface can then be rinsed and, if desired, exposed again to a solution of polycation to build up a suitable thickness of polycation on the modified surface. Alternatively, a modified surface can be prepared by providing a first layer of polycation onto the hydrophobic surface as described, and then building up a thin film of alternating polyanion and polycation using conventional layer-by-layer (LBL) deposition. Polyanions include sulfated poly(styrene) (SPS) and polyacrylic acid (PAA). When LBL deposition is finished, the top or outer layer of the modified surface is polycation. In various embodiments, it is preferred to use PAH as the polycation.

Suitable catalysts provide cationic or anionic metals that bind to the surface of the treated surface and, upon reduction to the zero valent state—such as by exposure to the subsequently applied electroless plating bath—provide catalytic sites for metal reduction and electroless deposition. Known catalysts include cationic or anionic complexes of metals such as Pd, Pt, Sn, Cu, and Ni. An example of a cationic metal catalyst is $Pd(NH_4)_4Cl_2$ (Strem Chemicals, Newburyport, Mass.), while an anionic catalyst is $Na_2[PdCl_4]$ (Aldrich). Suitable Cu and Ni catalysts include the respective acetates.

In addition to catalysis using noble metal species like those of Pd and Pt, less-expensive copper and nickel catalysts can be used. Thus in various embodiments, the use of costly Pd(II) salts is avoided by using cheaper surface bound Ni(II) and Cu(II) salts, which can be reduced in situ to catalytic metal seeds upon exposure to the electroless plating bath. In various embodiments, the methodology of Ni electroless plating makes use of copper acetate in ethanol solution as an organo metallic precursor. To illustrate, nickel ions are deposited on the treated surface of the polymer substrates, and then reduced either by plasma treatment in a $H_2$ or Ar atmosphere or chemically by a $NaBH_4$ solution, which is nom tally supplied as a component of the electroless plating bath. $NaBH_4$ is a strong reducing agent. When it is used the overall redox reaction can be written as follows.

$$4Ni^{2+}+BH_4^-+80H^-\rightarrow B(OH)^-+4Ni^0+4H_2O$$

As an example for Cu electroless plating, copper acetate in ethanol solution is used as organo-metallic precursor. Copper ions are deposited on the treated surface of the polymer substrates, and then reduced by 1) $NaBH_4$ solution, 2) heating at 270° C. under nitrogen, 3) by plasma in a Ar atmosphere, 4) by UV irradiation under vacuum. When $NaBH_4$ is used as the reducing agent, the overall redox reaction is as follows.

$$4Cu^{2+}+BH_4^-+80H^-\rightarrow B(OH)^-+4Cu^0+4H_2O$$

Further details and disclosure of the use of copper (II) and nickel(II) compounds as catalysts for electroless deposition are found in Charbonnier et al., "Copper metallization of polymers by a palladium-free electroless process," Surface Coatings and Technology, 200 (2006) 5478-5486, and in Charbonnier et al., "Ni direct electroless metallization of polymers by a palladium-free electroless process," Surface Coatings and Technology, 200 (2006) 5028-5036, the disclosures of both of which are hereby incorporated by reference.

In an exemplary process, a set of substrates comprising low density polyethylene (LDPE, semi-clear white), high density polyethylene (HDPE, semi-clear white), polypropylene (PP, semi-clear white) and polystyrene (PS, opaque white) are rinsed with detergent when received and afterwards dried, stored in a cabinet at room temperature. In various embodiments, no chemical treatment is applied.

A solution of the PAH (average Mw ~58,000, Sigma-Aldrich, St. Louis, Mo.) may be used, having a concentration of about 1 g/L, and with an ironic strength of 0.1 M sodium chloride (NaCl, ≥99%, Fisher Scientific, Pittsburgh, Pa.). The pH may be adjusted to 6.5 using 1 M sodium hydroxide (NaOH, Fisher Scientific).

As the electroless nickel (Ni) plating catalyst, sodium tetrachloropalladate (II) ($Na_2[PdCl_4]$, 98%, Sigma-Aldrich) can be used, for example, at 5 mM in DI water. The pH may be adjusted to 2 using 1 M hydrogen chloride (HCl, Fisher Scientific). Electroless Ni plating bath contained 4 g nickel sulfate (II) (99%, Sigma-Aldrich), 2 g sodium citrate (≥97%, Sigma-Aldrich), 0.2 g Dimethylamine borane (DMAB, 97%, Sigma-Aldrich), 1 g lactic acid (85%, Sigma-Aldrich) in 100 mL DI water. The pH may be adjusted to 6.5 using ammonium hydroxide ($NH_4OH$, 28%-30%, Fisher Scientific). Such methods among those useful herein include those described in Lee, I., P. T. Hammond, and M. F. Rubner, Selective electroless nickel plating of particle arrays on polyelectrolyte multilayers, Chemistry of Materials, 2003. 15(24): p. 4583-4589, incorporated by reference herein.

Deionized (DI) water supplied by a Barnstead Nanopure-UV 4 stage purifier (Barnstead International Inc., Dubuque, Iowa), equipped with a UV source and final 0.2 μm filter with a resistance ≥18.0 MΩ·cm can be used for all aqueous solution preparation and washing.

Ni Electroless Deposition

In an exemplary process, the substrates can be sequentially interacted with PAH for 30 min, catalyst for 15 min, and the Ni electroplating bath for 1 h, with a thorough rinse after each step with DI water. A clamp may be used to fix the sample. However, as for polymer pellets and spheres, the fixation and collection of samples may be more complicated because of their size and properties (e.g., density), specific methodologies were utilized. For example, PE pellets, having a lower density (0.91-0.95 g/cm$^3$) than water, may float on the surface of aqueous solutions and can only interact with chemicals partially. To overcome that problem, for each step, the PE pellets may be sent into a 15 mL centrifuge tube with the designated chemical solution, and rotated in a tube rotator (Krackeler Scientific Inc., Albany, N.Y.) at about 30 rpm for the same amount of time. By doing that, the PE pellets can fully interact with the designated chemicals and the floating issue can be addressed. After each step, PE pellets may be vacuum filtered and washed on a whatman filter paper #1 (Fisher Scientific, retention particle size about 11 μm). For PS microspheres, since their density (1.06-1.12 g/cm$^3$) is higher than water, the tube rotator was not used. Amicon Ultra-15 centrifugal tubes (Millipore Co., Billerica, Mass.) may be used in all steps for high recovery of the samples. A centrifuge at 6000 rpm for 15 min followed by a washing with DI water may be applied after each step.

Copper (Cu) Electrodeposition

Further in the exemplary process, the Ni coated PS thin sheets may then be further coated with Cu using electrodeposition. For example, a copper electrodeposition system may be set up as follows. A glass container (World Kitchen LLC, Greencastle, Pa.) can be placed on top of a stirrer/hot plate (model no. 11-300-49SHP, ThermoFisher Scientific, Barrington, Ill.), with a thermocouple placed into a non-cyanide electrolyte (Uyemura International Co., Ontario, Calif.) for temperature control. To eliminate the directional effect of the anode sheet, a rectangular niobium mesh (Larry King Co., Rosedale, N.Y.) may be used. A PS thin sheet substrate may be placed in the middle of the mesh, and also in parallel with the long dimension of the anode mesh. Meanwhile, each side of the mesh may be attached with a copper anode (Mcmaster-Carr, Santa Fe Springs, Calif.). An electrolyte of 40 g/L Cu was used at 65° C. and a pH of 7.5. A potentiostat (Allied Plating Supplied, Inc., Hialeah, Fla.) with a maximum output of 15 amperes and 12 volts can be applied, while using a stirring bar throughout the entire deposition process at 180 rpm. The current density can be maintained at about 10 mA/cm$^2$, for example, until the desired amount of deposition is achieved. Such methods among those useful herein include those described in Wang, W., et al., Nano-deposition on 3-D open-cell aluminum foam materials for improved energy absorption capacity, (submitted for publication).

The methods of the present technology are exemplified by the following non-limiting examples and discussion.

EXAMPLES

Scanning Electron Microscope (SEM) Imaging

Ni coated samples made as described above were evaluated through scanning electron microscope (SEM) imaging using a Zeiss EVO LS 25 variable pressure SEM. The microscope was equipped with an energy dispersive x-ray (EDX) detector to determine atomic compositions. Colors with great contrast were deliberately chosen to label the present element in the designated area. Before imaging, polymer thin sheets were sputter coated with gold (Au) under vacuum (Leica EM MED020, Buffalo Grove, Ill.), until a 3.5 nm coating thickness was achieved.

The dried samples were sent into the chamber without further conditioning and a high vacuum mode was selected during the imaging. Unless otherwise stated, all SEM images were taken at a 16 kV accelerating voltage and a 25 mm working distance. The EDX studies were performed at a 16 kV accelerating voltage and a 9 mm working distance.

Ni coated HDPE and PS thin polymer sheets were recorded with the mass and morphology change, as a function of coating time. At the designated time window each specimen was pictured with a digital camera. Before each time the sample was weighed, it was dried with $N_2$ air at room temperature.

PE pellets and PS microspheres were observed using an Olympus optical microscope with magnification ranging from 5× to 1000×. A spot Camera is equipped with the microscope for recording digital micrographs. For all images acquired with the optical microscope, a reflection mode was selected unless otherwise noted.

Four different neutral hydrophobic polymers were selected as substrates for Ni electroless deposition. Three major steps were included in the following order: 1) an immersion in PAH; 2) an immersion in Pd catalyst; 3) an immersion in Ni electroless plating bath.

FIG. 1 shows an illustrative scheme of Ni electroless deposition on neutral hydrophobic thin polymer sheets. Firstly, the application of PAH induced hydrophobic interactions with the designated polymer, and therefore the PAH was adsorbed onto the polymer surface. The long carbon chain backbones exists in both the PAH and the polymer substrate are hydrophobic, therefore exhibiting a repulsive nature to aqueous solution and tends to assemble each other. It should be noted that while hydrophobic interaction is not a strong interaction, it is still stronger than Van der Waals interactions or hydrogen bonds. A variety of conformation of PAH on hydrophobic surfaces was investigated in the previous study. When the PAH chains are fully charged, a stretched conformation may be obtained due to the electrostatic forces between charged groups on the chains. And the weak polyelectrolyte nature of PAH has a reversible equilibrium of dissociation, which is largely dependent on its local pH and ionization. At a pH lower than pKa value context (pKa of PAH is 8.7), PAH is primarily protonated and therefore spread on to the substrate surface. An increasing ionic strength will give rise to a decreased layer thickness because of the spreading of the PAH chains to the surface. At the same time, because of the ionization the PAH chains are exhibiting a certain degree of "coiling conformation", which is shown in FIG. 1. The "coiling conformation" results in a random distribution of charged group, both on the substrate surface and throughout the thickness of the adsorbed PAH layer. Secondly, a catalyst deposition was applied by immersing PAH modified substrate, enabling an electrostatic interaction between the pronated PAH (positively charged) and the catalyst (negatively charged). Because of the distribution of the positive charges, catalyst is attracted and catalytic sites are created throughout the PAH layer thickness. Finally, when the designated polymer thin sheet is submerged into the Ni electroless plating bath, the redox reaction of Ni cations to Ni occurs at the corresponding catalytic sites (where catalyst is present) and forms a thin layer of Ni coating.

Figure 2:
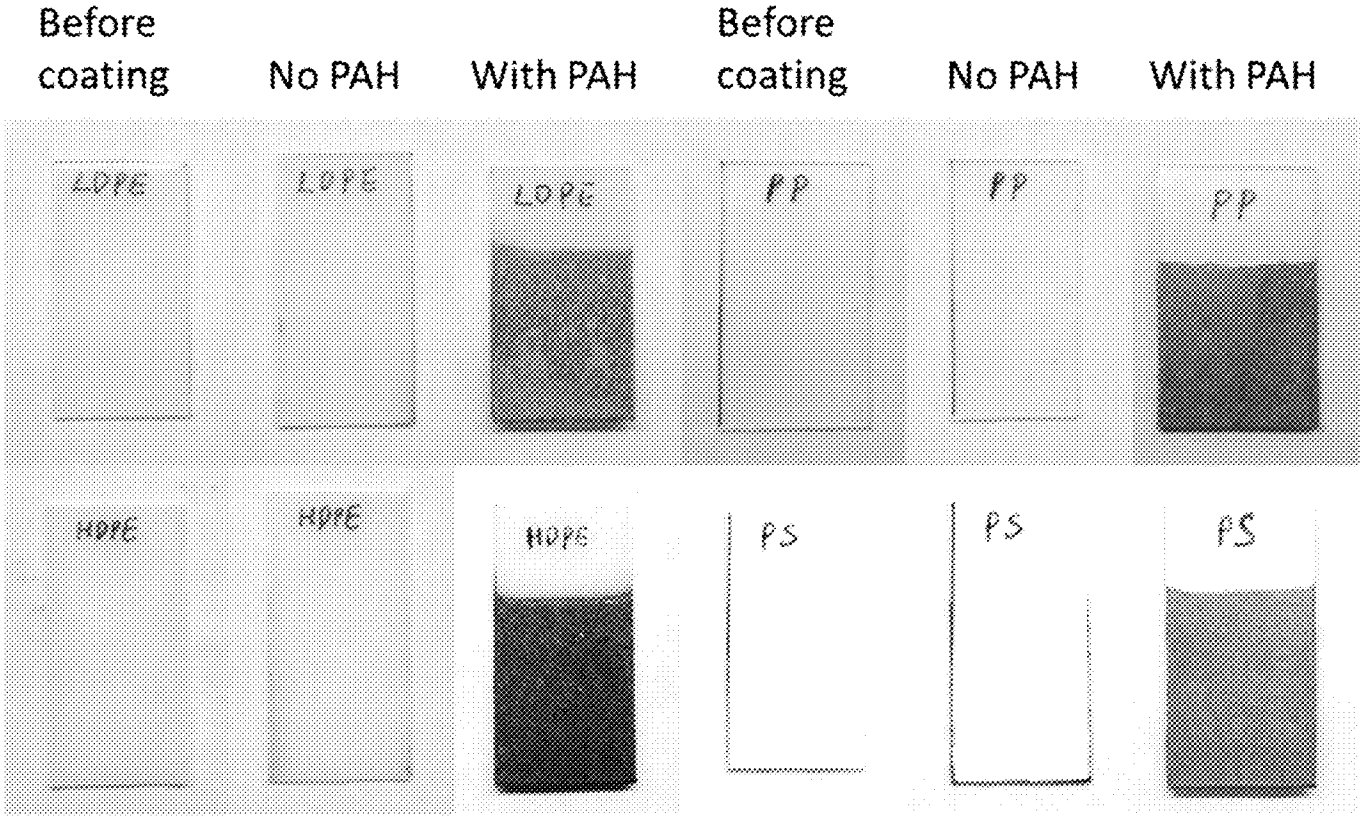
FIG. 2 is a photograph showing a comparison of polymer substrates before and after metal deposition according to the methods of the present technology.
Figure 3:
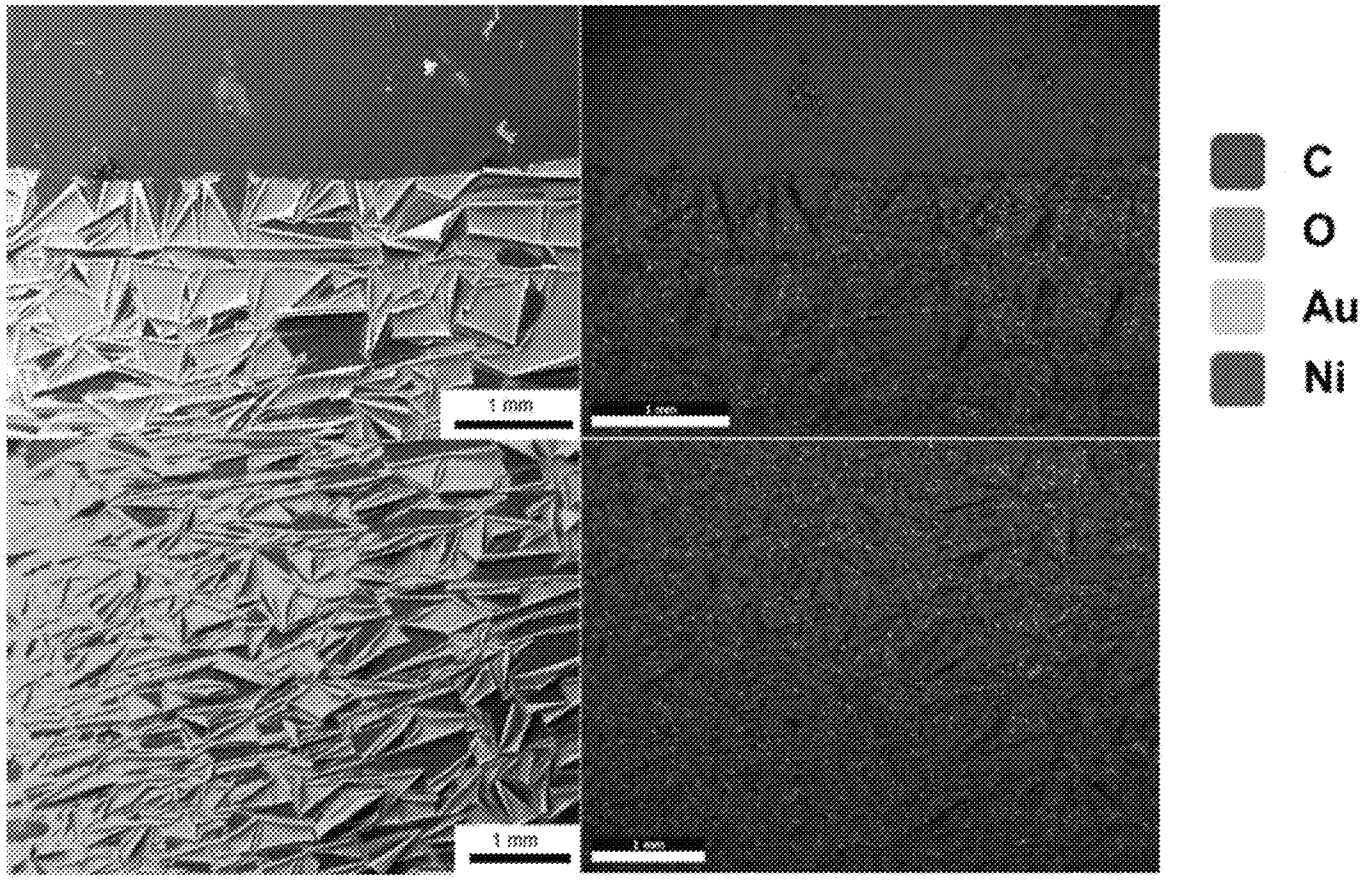
Figure 4:
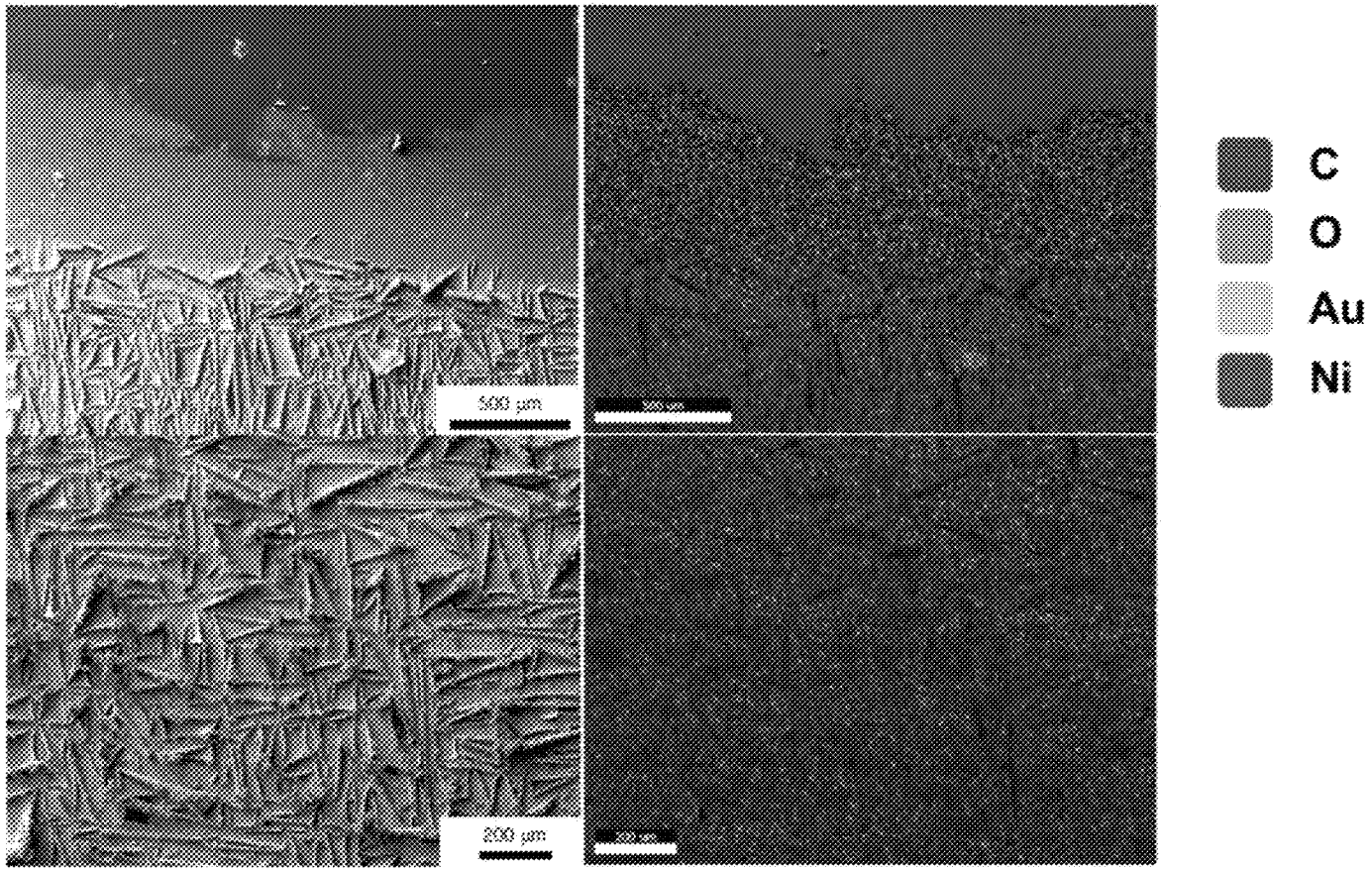
Figure 5:
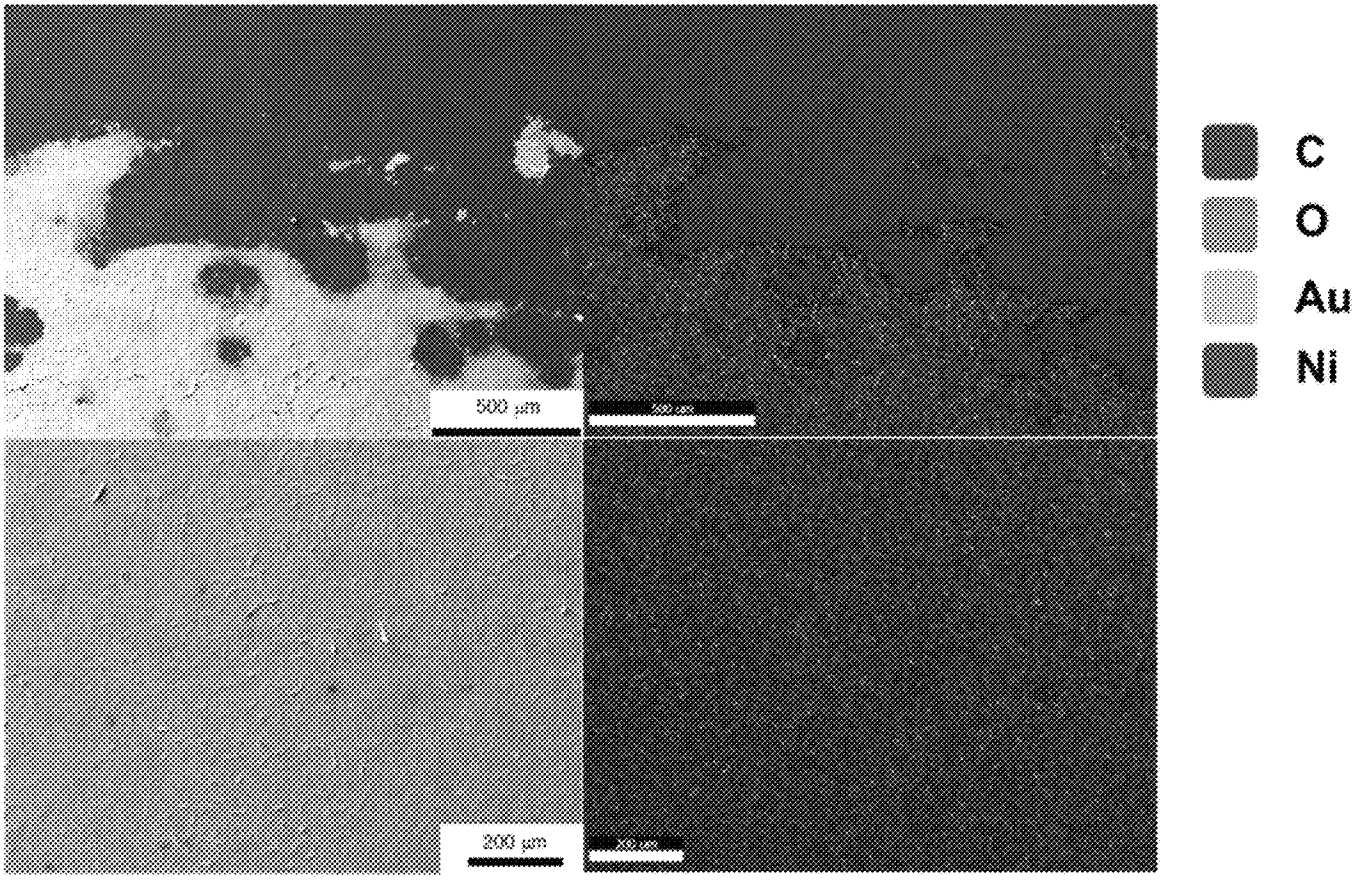
Figure 6:
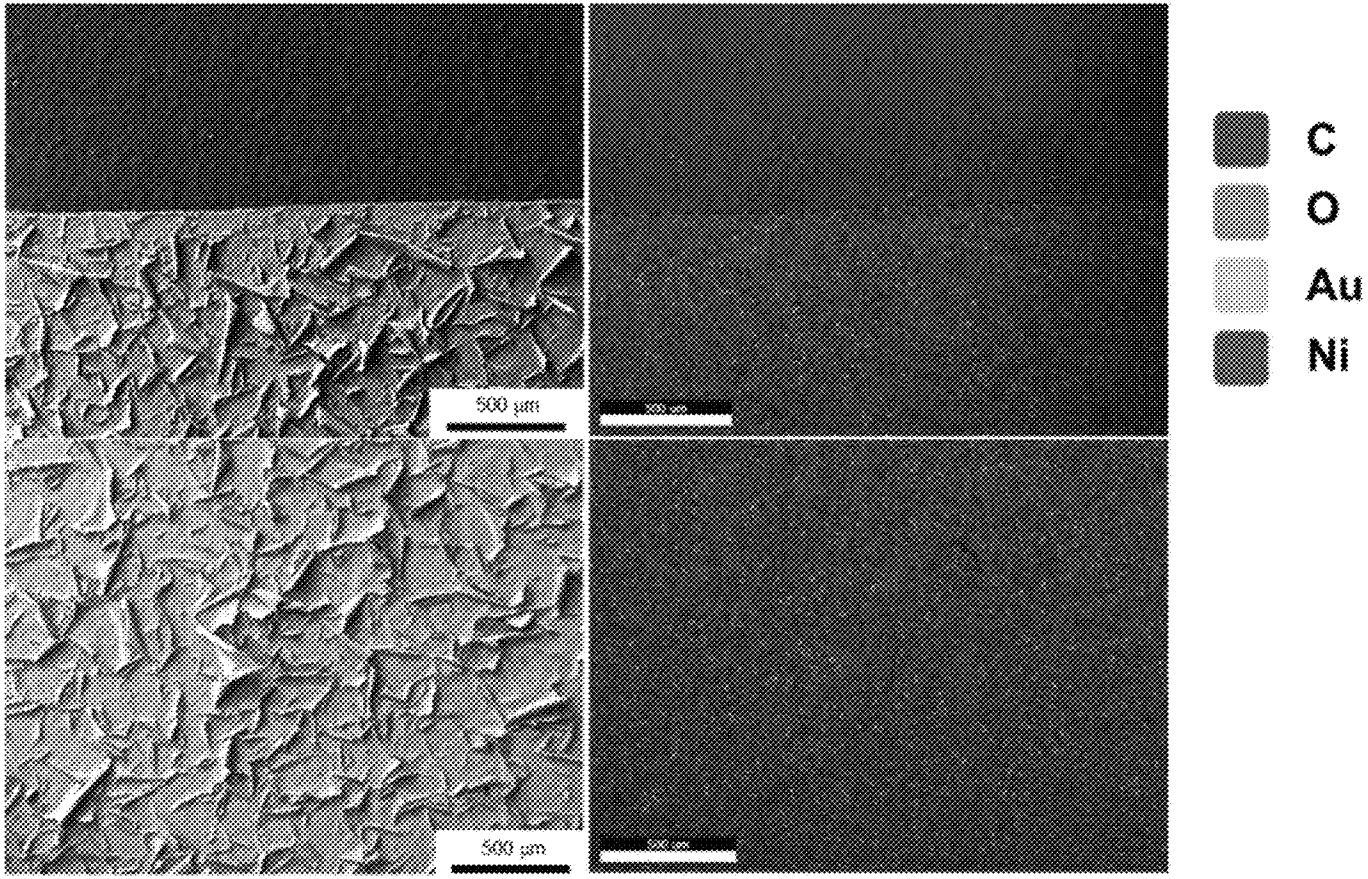

A control experiment was performed with an exclusion of step 1. FIG. 2 shows a systematic comparison of designated polymers before and after Ni deposition. Without an inclusion of PAH, all designated polymers were not deposited with Ni at all. Previous research has shown that with the same Ni electroless plating bath, no Ni coating was formed without the catalyst. Combined with that result, it is evident that Ni coating was not formed on the polymer surface due to the fact that no catalyst was attached. However, with an inclusion of PAH, Ni was successfully formed onto all designated polymers.

Morphologies of Ni coating on different polymers were observed by SEM. The Ni deposition on all designated polymer thin sheets was achieved. A representative image at the coating/polymer edge and a representative image at the main coating body were showed, for each designated polymer sheet. An EDX elemental mapping investigation was performed and presented next to the corresponded SEM image, as shown in FIGS. 3-6. The Ni on the LDPE exhibited an exfoliated film coating, with a large portion of the uncoated area in the main coating body. All other substrate showed an improved coating quality in terms of the Ni coverage at the main coating body. HDPE and PP thin sheets exhibited similar Ni coating coverage. The PS thin sheet exhibited a superior Ni coating coverage that the polymer was no longer detected (0% of C). Other than Au (which is artificially sputter coated for imaging purposes), the percentage of Ni coverage on those four polymer thin sheets can be ranked in the descending order, as follows: PS>PP≈HDPE>LDPE.

FIGS. 7 and 8 depict a gradual morphology change along with coating time on a HDPE thin sheet and a PS thin sheet, respectively. The depositions of Ni on catalyst-seeded HDPE and PS thin sheets are almost instantaneous. Both substrates have a Ni coating at the 1st min of coating. And in the first 10 min of coating, both substrates exhibit a severe morphology change, due to the Ni coating formation. It was also noted that for both polymers, after 30 min of coating, the morphology of them remain almost unchanged. It is probably due to the fact that the horizontal coverage of Ni reaches plateau in that time frame, and the vertical thickness growth became dominant, which will not result in any change in its outlook.

The thickness gain over time can provide us more details. The nominal thickness gains of two polymer thin sheets were plotted against coating time in FIG. 9. The thickness gains for non-PAH modified HDPE and PS remained zero for 2 hours of coating. The nominal thickness gain was calculated by dividing Ni mass gain by the surface area of designated coating area, as demonstrated in equation (1).

$$T = \frac{\Delta m}{\rho[2L_d(w+h)+wh]} \tag{1}$$

where, T denotes the coating thickness, Δm denotes mass gain in each designated time window, ρ denotes the density of the coated material, $L_d$ denotes the long dimension of designated coated area, w denotes the width of the polymer sheet, which equals 25.4 mm, h denotes the thickness of the polymer sheet, which equals 0.16 mm. From the curve, over 2 hours of Ni electrodeposition, both substrates gained approximately 2 μm coating thickness. However, the HDPE substrate showed a plateau behavior after 1 hour of coating; whereas the PS substrate exhibited a decreasing trend in terms of thickness gain over time after 1 hour, the thickness gain rate was still faster than that of HDPE in that time frame.

One of the disadvantages of electroless deposition is that, it only can achieve a few microns or even submicron size thickness, even in hours of processing. This limitation can be overcome by an electrodeposition method, in which an applied electro-field forces a current flow through an electrochemical cell to cause chemical changes. The electrodeposition can achieve more than a hundred microns coating thickness in hours. In order to electroplate a substrate which is non-conductive, a thin layer of metal induced by electroless plating is usually applied to reinforce the conductivity, allowing the substrate to be electroplated with either homogeneous or heterogeneous materials afterwards. To address the aforementioned issues and to demonstrate the feasibility, Ni coated polymer sheets may be electroplated with Cu.

Again a control experiment was conducted, in which an uncoated PS sheet was electroplated in the same electrodeposition system. As expected, no Cu deposition was achieved, simply because of the non-conductive nature of the PS. On the contrary, a Ni coated PS thin sheet was electroplated in the same system, and Cu deposition was successfully achieved (see FIG. 10). The Cu deposition was visually reddish-orange. It should be noted that although the whole sheet was immersed in the electrolyte and subjected to electrodeposition, only the Ni coated portion was electrodeposited. Similarly SEM imaging and corresponding EDX investigations on the edge of the coating and the main coating body were conducted. A full coverage of Cu on to the Ni coated PS sheet was observed. Upon certain thickness of Cu deposition, the designated polymer and Ni were not able to be detected.

The following methodology can be applied to calculate the nominal coating thickness gain over time. The mass gain fulfills the classic Faraday's law of electrolysis [46] as a function of time, at constant current, $$\Delta m = \frac{IM}{Fz} \times t \tag{2}$$

where I denotes the applied current, M denotes the molar mass of deposited metal, F denotes Faraday's constant, z denotes the valency number of deposited element, t denotes time (in second(s)). Equation (1) can be still used to calculate the thickness gain of deposition, except for the denotation of mass gain. Here it represents the mass gain in electrodeposition. If substitute equation (1) with equation (2), $$T = \frac{IM}{Fz} \times \frac{t}{\rho[2L_d(w+h)+wh]} \tag{3}$$

thus, a nominal thickness evaluation of metal electrodeposition as a function of time can be obtained.

In further experiments, all substrates are coated with Ni following the same process route as the polymer thin sheets as described above. FIG. 12 shows an illustrative scheme of Ni electroless deposition on neutral hydrophobic polymer pellets and spheres. The mechanism for the formation of the Ni coating is the same, other than the geometry and dimension of the substrate.

FIG. 13 depicts a set of studies of PE pellets before and after Ni deposition. A control experiment was also performed with an exclusion of step 1 (PAH dipping). Without an inclusion of PAH, PE pellets remained uncoated. With an inclusion of PAH, PE pellets were successfully deposited with Ni, even though the Ni coverage is not perfect on some of the pellets.

Morphologies of Ni coated PE pellets were observed by SEM (see FIG. 14). The coating looks similar to that on the polymer thin sheets. A comparison before and after Ni electroless plating was made with EDX. With the help of EDX, an area scanning proved formation of Ni on the coated sample (FIG. 14 (*b*)); whereas no Ni peak was observed in the uncoated one (FIG. 14(*a*)).

PS microspheres are commercially provided with specific surface charge functionalities, ideally negative (e.g. carboxylate-modified PS), positive (e.g. amine-modified PS) and neutral (e.g. plain PS). But in reality, they can be deviated because of the fabrication methodology. An emulsion polymerization process is usually employed for fabrication of monodispersed size PS, since this method can precisely control the particle size with a narrow polydispersity. This methodology includes: 1) formation of micelles from surfactant molecules; 2) addition of monomers (styrene), entering of monomers into micelles; 3) addition of an initiator to induce polymerization; 4) polymerization termination by sulfate ions from the initiator, which remain at the sphere surface. This mechanism gives rise to the aggregation of anions at the surface, making the surface with charges (negative), even without functional group. Excessive amount of surfactant will largely decrease surface charges of the sample. Actually the surface charge of the plain PS purchased from Polysciences (Warrington, Pa.) was tested, and gave the value of −20.24±1.09. The variation may exist among different batches, but still, that value is considered mildly negative.

With that in mind, polystyrene microspheres were also Ni electroless plated in our work. A same coating strategy was used. A control study showed no Ni deposition was observed when PAH was excluded. Because there is no hydrophobic interaction, also PS surface and the catalyst are both negatively charged, making the catalyst impossible to be attached. However, if the PS has a positive surface functionality, the catalyst will be adsorbed by electrostatic interactions. A similar work has been done by previous researchers. But when PAH was included, the Ni coating was formed (see FIG. 15). However, the morphology of Ni coated PS microspheres looked totally different from the coating formed on other samples (polymer thin sheets, PE pellets). Instead of Ni thin films, small size Ni grains were formed on the PS microspheres. It could be ascribed to the fact that the electrostatic and hydrophobic interactions play together, attracting PAH in different conformations and therefore forming Ni deposition in a different way.

Non-Limiting Discussion of Terminology

The headings (such as "Introduction" and "Summary") and sub-headings used herein are intended only for general organization of topics within the present disclosure, and are not intended to limit the disclosure of the technology or any aspect thereof. In particular, subject matter disclosed in the "Introduction" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

The description and specific examples, while indicating embodiments of the technology, are intended for purposes of illustration only and are not intended to limit the scope of the technology. Moreover, recitation of multiple embodiments having stated features is not intended to exclude other embodiments having additional features, or other embodiments incorporating different combinations of the stated features. Individual elements or features of a particular embodiment are generally not limited to that particular embodiment, but, where applicable, are interchangeable and can be used in a selected embodiment, even if not specifically shown or described. The same may also be varied in many ways. Specific examples are provided for illustrative purposes of how to make and use the compositions and methods of this technology and, unless explicitly stated otherwise, are not intended to be a representation that given embodiments of this technology have, or have not, been made or tested. Equivalent changes, modifications and variations of some embodiments, materials, compositions and methods can be made within the scope of the present technology, with substantially similar results.

As used herein, the words "prefer" or "preferable" refer to embodiments of the technology that afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the technology.

As used herein, the word "include," and its variants, is intended to be non-limiting, such that recitation of items in a list is not to the exclusion of other like items that may also be useful in the materials, compositions, devices, and methods of this technology. Similarly, the terms "can" and "may" and their variants are intended to be non-limiting, such that recitation that an embodiment can or may comprise certain elements or features does not exclude other embodiments of the present technology that do not contain those elements or features.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components or process steps, the present technology also specifically includes embodiments consisting of, or consisting essentially of, such materials, components or processes excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein. Further, as used herein the term "consisting essentially of" recited materials or components envisions embodiments "consisting of" the recited materials or components.

"A" and "an" as used herein indicate "at least one" of the item is present; a plurality of such items may be present, when possible. "About" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters.

What is claimed:

1. A method for coating a metal on a hydrophobic surface of a substrate, comprising (a) contacting the hydrophobic surface with a polycation to create a treated surface comprising the polycation;

(b) contacting the treated surface with a catalyst; and (c) immersing the surface of step (b) in an electroless plating bath of the metal to create a coating of the metal on the surface.

2. The method according to claim 1, wherein the substrate is in the form of particles having a dimension of 10 nm-1 cm.

3. The method according to claim 1, wherein the metal comprises copper, silver, gold, nickel, or cobalt.

4. The method according to claim 3, wherein the metal is copper or nickel.

5. The method according to claim 1, wherein the substrate comprises a hydrophobic polymer selected from the group consisting of polyethylene, polypropylene, polystyrene and mixtures thereof.

6. The method according to claim 1, wherein the catalyst comprises a compound of palladium, tin, copper, or nickel.

7. The method according to claim 1, wherein the electroless plating bath comprises sodium borohydride.

8. The method according to claim 1, wherein the polycation of step (a) is branched poly(ethyleneimine) or linear poly (ethyleneimine).

9. The method according to claim 1, wherein the polycation is poly (diallyldimethylammonium chloride).

10. The method according to claim 1, wherein the polycation of step (a) is poly(allylamine) hydrochloride (PAH).

11. The method according to claim 10, wherein the substrate comprises a hydrophobic polymer selected from the group consisting of polyethylene, polypropylene, polystyrene and mixtures thereof.

12. The method according to claim 1, wherein the catalyst comprises Pd.

13. The method according to claim 1, wherein the catalyst comprises Ni or Cu.

14. The method according to claim 1, wherein the substrate comprises particles of dimension 0.1 mm-1 cm.

15. The method according to claim 1, wherein the substrate comprises particles of dimension 1-50 micrometers.

16. A method for forming a metal coating on a substrate comprising a hydrophobic polymer, comprising (a) contacting the substrate with poly(allylamine hydrochloride) (PAH) to create a treated surface comprising the PAH;

(b) contacting the treated surface with a catalyst comprising Pd, Pt, Sn, Ni, or Cu; and (c) immersing the surface in an electroless metal plating bath to create a coating of the metal on the surface, wherein the meta is nickel or copper.

17. The method according to claim 16, wherein the catalyst comprises Ni or Cu.

18. The method according to claim 16, wherein the substrate is in the form of spherical particles.

19. The method according to claim 16, wherein the method is carried out without etching of the substrate before contacting with PAH.

* * * * *